US007237423B1

(12) United States Patent
Nagel et al.

(10) Patent No.: US 7,237,423 B1
(45) Date of Patent: Jul. 3, 2007

(54) APPARATUS FOR STRETCH FORMING BLANKS

(75) Inventors: Keith Nagel, Juneau, WI (US); Robert Riehbrandt, Beaver Dam, WI (US)

(73) Assignee: Miller Tool and Die Company Inc., Mayville, WI (US)

( * ) Notice: Subject to any disclaimer, the term of this patent is extended or adjusted under 35 U.S.C. 154(b) by 129 days.

(21) Appl. No.: 10/986,419

(22) Filed: Nov. 12, 2004

(51) Int. Cl.
*B21D 22/00* (2006.01)
*B21D 22/21* (2006.01)

(52) U.S. Cl. ..... 72/350; 72/351

(58) Field of Classification Search ..... 72/350, 72/351, 379.2, 453.13, 359, 348, 347, 702
See application file for complete search history.

(56) References Cited

U.S. PATENT DOCUMENTS

| | | | | |
|---|---|---|---|---|
| 2,989,019 | A * | 6/1961 | Sciver, II | 72/340 |
| 3,435,653 | A * | 4/1969 | Scaletta et al. | 72/336 |
| 3,564,895 | A * | 2/1971 | Pfanner et al. | 72/351 |
| 3,789,649 | A | 2/1974 | Clowes | |
| 4,090,389 | A | 5/1978 | van Denderen et al. | |
| 4,193,285 | A | 3/1980 | Zumsteg | |
| 4,425,778 | A | 1/1984 | Franek et al. | |
| 4,603,571 | A | 8/1986 | Wessels | |
| 4,615,204 | A | 10/1986 | Yamamoto et al. | |
| 4,790,169 | A | 12/1988 | Johansson et al. | |
| 5,035,133 | A * | 7/1991 | White et al. | 72/350 |
| 5,209,099 | A | 5/1993 | Saunders | |
| 5,507,189 | A | 4/1996 | Kim et al. | |
| 5,600,991 | A | 2/1997 | Munzen | |
| 5,644,943 | A | 7/1997 | Lanz | |
| 5,689,992 | A | 11/1997 | Saunders et al. | |
| 5,794,482 | A | 8/1998 | Walkin | |
| 5,901,599 | A | 5/1999 | Sato et al. | |
| 5,979,211 | A | 11/1999 | Pahl et al. | |
| 6,006,578 | A | 12/1999 | Reitter | |
| 6,167,742 | B1 | 1/2001 | Marin | |
| 6,339,949 | B1 | 1/2002 | Takamatu | |
| 6,505,492 | B2 | 1/2003 | Jroski | |
| 6,568,064 | B2 | 5/2003 | Kanno et al. | |
| 6,619,095 | B2 * | 9/2003 | Matsuoka | 72/315 |
| 6,622,539 | B2 | 9/2003 | Hartzinger et al. | |
| 2002/0095968 | A1 | 7/2002 | Matsunaga | |

* cited by examiner

*Primary Examiner*—Lowell A. Larson
*Assistant Examiner*—Teresa M. Bonk
(74) *Attorney, Agent, or Firm*—Ryan, Kromholz, and Manion, S.C.

(57) ABSTRACT

A blank is stretch formed into a formed piece by bending the blank over a stationary punch. A draw ring has a step that cooperates with a pad ledge to create a step-ledge. The blank is bent with a reverse bend at the step-ledge. Subsequently, the step-ledge travels a short distance relative to the punch to stretch the blank material. Step-ledge travel is achieved by pre-charged cylinders that travel slightly in response to a force exerted on the draw ring and step-ledge by the press ram after the blank is bent into the reverse bend. The formed piece is cut along a plane through a wall thereof to make a finished piece. The finished piece free edge remains stable and in the same position as when in the press. Consequently, the free edge can be readily aligned with and welded to the free edge of a second finished piece.

21 Claims, 11 Drawing Sheets

FIG. 4
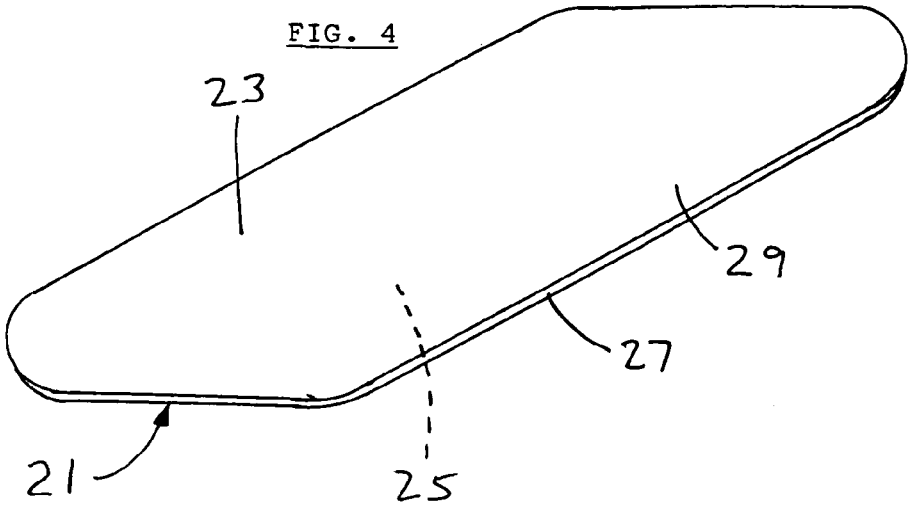
FIG. 12
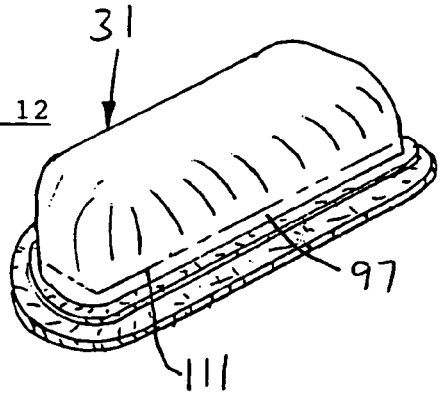
FIG. 14
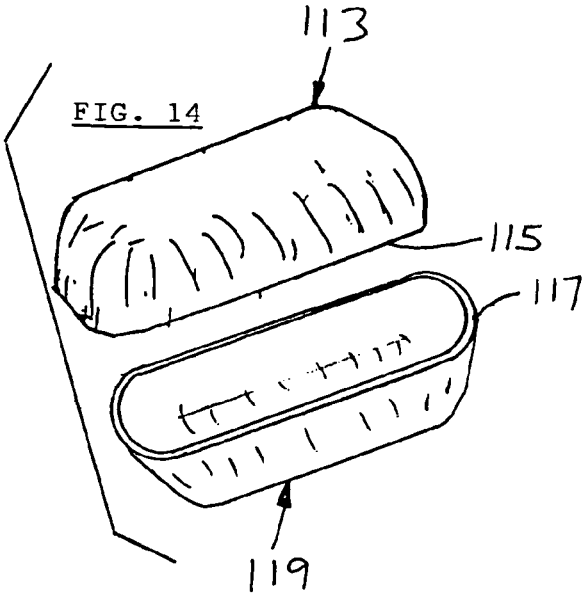
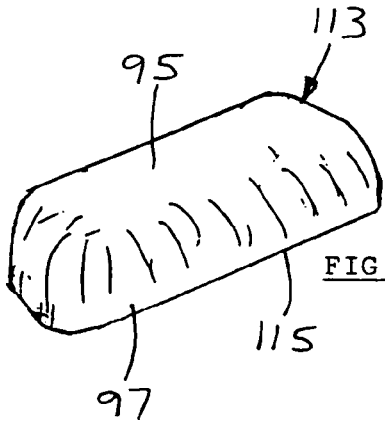
FIG. 13

APPARATUS FOR STRETCH FORMING BLANKS

BACKGROUND OF THE INVENTION

1. Field of the Invention

The present invention pertains to metal fabricating, and more particularly to apparatus that bends and stretches metal blanks.

2. Description of the Related Art

Various equipment has been developed to deep draw flat blanks of metal into three-dimensional pieces. The drawing process involves controlled flowing of material as the blank is forced over a punch of desired size and shape during a draw stroke. The blank is held around its outer margins between a draw ring and a blank holder as the blank central region is forced over the punch to from the finished piece.

To rigidly hold the blank in place during the forming process, it is known to employ draw beads in the draw ring and blank holder. The draw beads provide a very large gripping force on the blank margins such that they do not slip in the draw ring or blank holder during the draw stroke. Examples of prior equipment with draw beads may be seen in U.S. Pat. Nos. 5,507,189 and 5,644,943, and in U.S. published patent application 2002/0095968. The foregoing patents and published patent application show complementary male and female components that are integral with the draw ring and blank holder. In other prior equipment, the draw beads consist of loose male members in one or other of the draw ring or blank holder, which are complementary to recesses in the other of the draw ring or blank holder.

In many instances, the blank was formed into a piece having a continuous wall, a domed end, and a flange extending outwardly from the wall. After the draw stroke was complete, the formed piece was removed from the draw ring and blank holder. The wall was often cut to remove the flange, which was discarded. The finished piece thus consisted of the wall and the domed end integral with the wall.

It is also know to employ a stationary step and ledge design to tightly grip the blank margins only at the end of the draw stroke. FIGS. 1–3 show a prior draw ring 1 with a step 3. A stationary punch 5 has a mating ledge 7. As the draw ring 1, blank holder 9, and blank 11 near the end of the draw stroke, arrow 12, the blank material is formed at reference numeral 13 into a double bend between the draw ring step 3 and the punch ledge 7. The double bend 13 tightly grips the blank 11 at the completion of the draw stroke. After the draw stroke is completed, the piece wall 15 is cut along the plane 17. The step and ledge design is sometimes used in combination with the draw beads discussed previously.

A common problem involving deep drawn pieces with continuous walls was that the wall free edges tended to spring outwardly after the flanges were cut away. The spring back occurred whether the draw beads, the step and ledge, or the combination of the draw beads and step and ledge were used to grip the blank.

For many types of pieces, the spring back was tolerable. On the other hand, some pieces could not tolerate any spring back. For example, a certain prior automotive fuel tank was manufactured by matching the free edges of two formed pieces and welding the two free edges together to make the tank. However, the spring back of the two pieces made it very difficult to align their free edges and weld them. Consequently, the scrap rate was unacceptably high.

Thus, a need exists for improvements in the process for deep drawings metal blanks.

SUMMARY OF THE INVENTION

In accordance with the present invention, apparatus for stretch forming blanks is provided that produces stable three-dimensional pieces from flat blanks. This is accomplished by apparatus that includes a traveling step-ledge made from a pad ledge and a cooperating draw ring step.

The present invention is incorporated into a conventional deep draw press having a bed. Pins guide a blank holder for reciprocating along a longitudinal axis relative to the bed. The blank holder and draw ring surround a punch. The punch has a first end that is contoured to the size and shape of the piece to be formed according to the present invention. According to one aspect of the invention, the punch first end includes a continuous side surface that is generally parallel to the longitudinal axis, and a convex surface that blends into the side surface.

A pedestal rigidly supports a second end of the punch on the bed. The pad is between the punch second end and the bed, alongside the pedestal. The pad ledge extends transversely from the continuous side surface of the punch second end. The pad rests on the pistons of several fluid cylinders in the press bed. The fluid cylinders are pre-charged such that a considerable force is required to push their pistons into the cylinder housings. The draw ring is reciprocable along the longitudinal axis by means of a press ram. Near the completion of a ram draw stroke, the draw ring step approaches the pad ledge and cooperates with it to create a step-ledge.

In operation, the press is opened such that there is a space between the draw ring and the blank holder. A holding surface of the blank holder is approximately coplanar with an apex of the punch first end. The bottom surface of a blank of the desired size and shape is placed on the blank holder holding surface. The ram advances the draw ring to contact a top surface of the blank. The ram forces the draw ring, blank holder, and blank together in a draw stroke along the longitudinal axis toward the press bed. That action bends the blank over and around the punch first end. According to the first aspect of the invention, the bent blank has a domed end and an integral continuous wall. The domed end includes a crown section that is adjacent and corresponds in configuration to the punch apex. As the ram approaches the completion of the draw stroke, the draw ring step approaches the pad ledge and cooperates with it to create the step-ledge. The blank wall is bent at the step-ledge into a reverse bend. The margin of the blank is bent into a flange that is transverse to the longitudinal axis.

Ultimately, all clearance between the step-ledge and the blank reverse bend is taken up. Continued advancement of the ram forces the draw ring step, acting through the blank reverse bend, to push the pad against the pistons of the pre-charged cylinders. The force exerted by the ram is sufficient to overcome the pre-charge force of the cylinders. Consequently, the step-ledge, together with the blank reverse bend and flange, travel a short additional distance relative to the punch until the completion of the draw stroke. The punch remains stationary during the entire draw stroke. As a result, the blank material between the crown section and the reverse bend is stretched an amount equal to the travel of the step-ledge.

At the completion of the draw stroke, the press is opened to remove the formed piece. The formed piece is cut to remove the reverse bend and flange, which results in the finished piece.

The outstanding benefit of the present invention is that the free edge of the finished piece does not spring back after the reverse bend and flange have been cut away. It is believed that the stretch imparted to the blank material due to the travel of the step-ledge stabilizes the blank material against spring back. As a result, the free edges of two finished pieces can be easily aligned and welded together.

The method and apparatus of the invention, using a traveling step-ledge, thus enable flat metal blanks to be stretch formed into three-dimensional pieces having free edges that do not spring back after forming. The probability of a defective piece is remote, even though no changes are made to the blank material properties.

Other advantages, benefits, and features of the invention will become apparent to those skilled in the art upon reading the detailed description of the invention and studying the drawings.

BRIEF DESCRIPTION OF THE DRAWINGS

FIG. 4 is a perspective view of a typical blank of material that is deep dawn according to the present invention.

FIG. 12 is a perspective view of the piece formed according to the apparatus of FIGS. 5–11 made from the blank of FIG. 4.

FIG. 13 is a perspective view of the finished piece made from the formed piece of FIG. 12.

FIG. 14 is a perspective view of the finished piece of FIG. 13 aligned with a second finished piece.

DETAILED DESCRIPTION OF THE INVENTION

Figure 1:
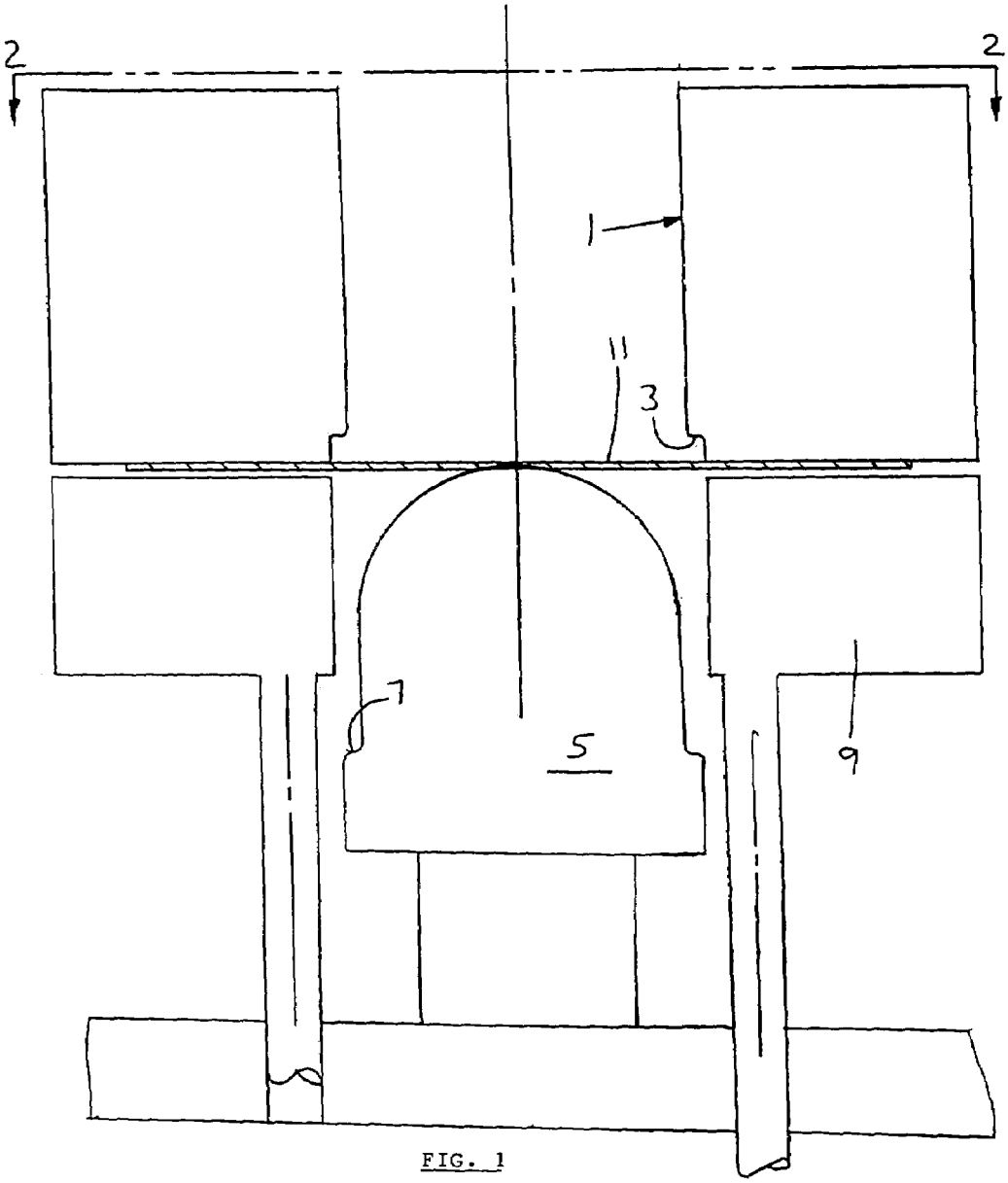
FIG. 1 PRIOR ART
FIG. 1 is a simplified view of prior equipment for deep drawing blanks of material at the start of the draw stroke.
Figure 2:
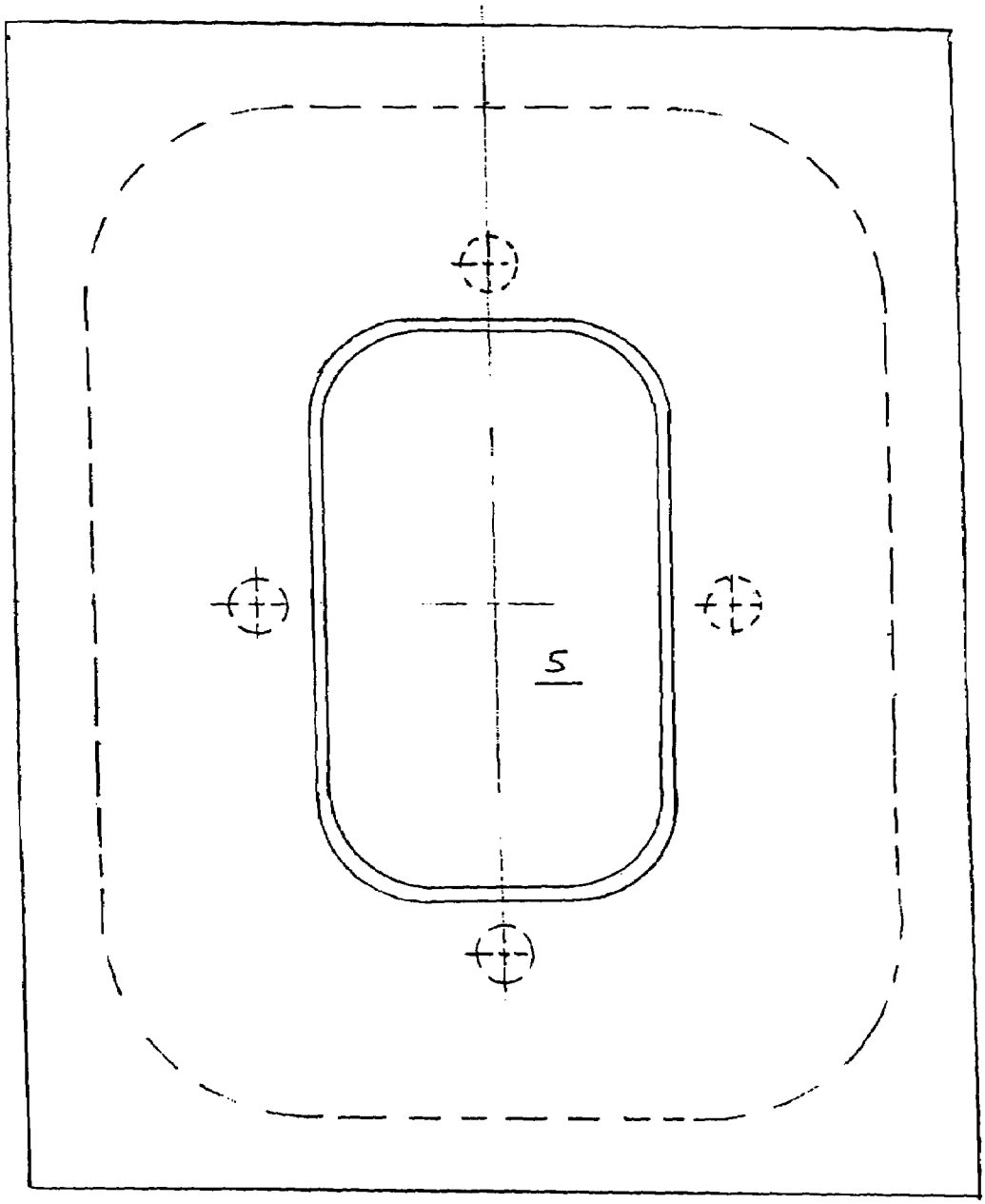
FIG. 2 PRIOR ART
FIG. 2 is a view taken along line 2—2 of FIG. 1.
Figure 3:
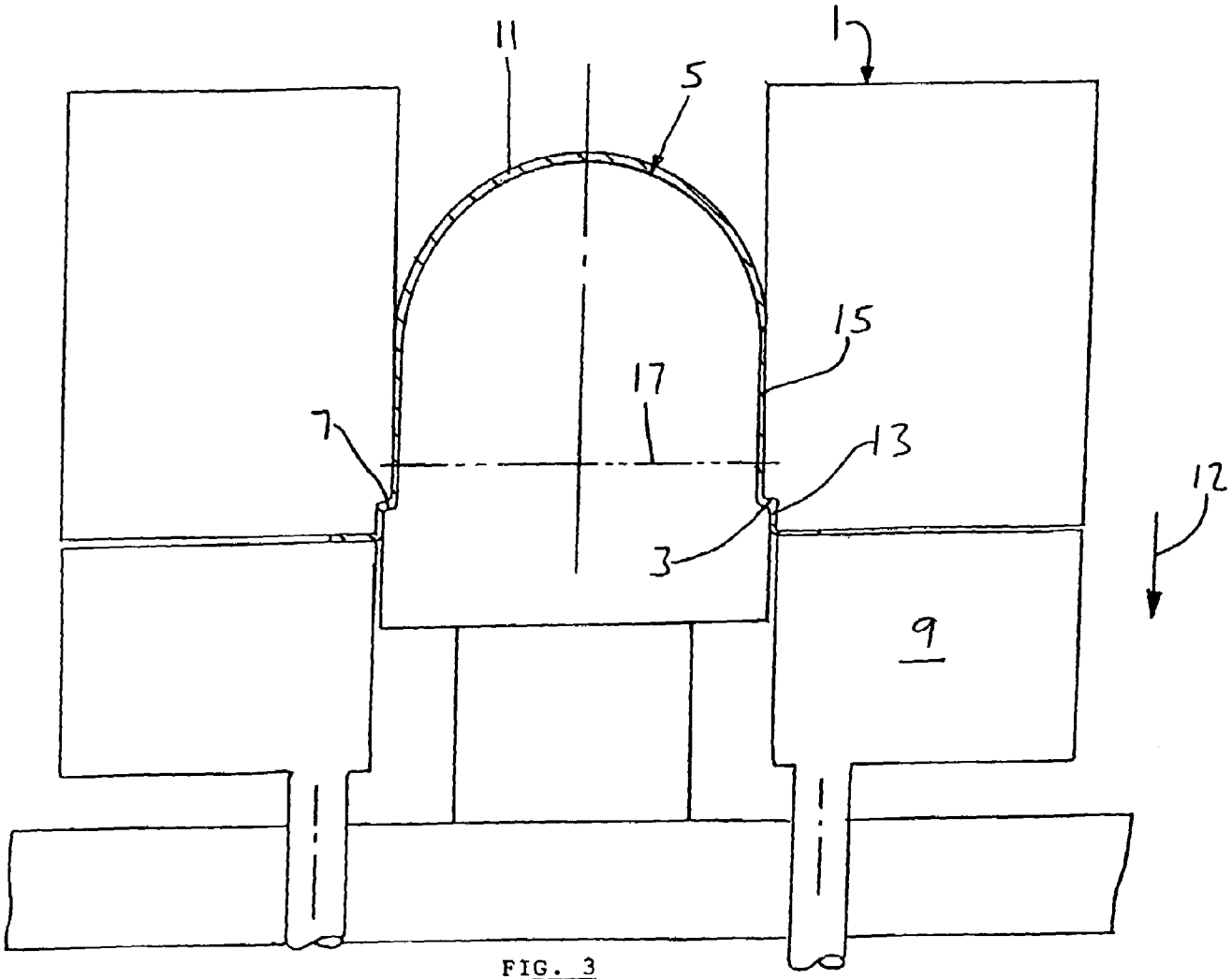
FIG. 3 PRIOR ART
FIG. 3 is a view similar to FIG. 1, but showing the equipment at the end of the draw stroke.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring first to FIGS. 4, 12, and 13, a blank 21 is illustrated that is stretch formed into a formed piece 31 according to the present invention. The particular blank 21 and formed piece 31 shown are merely representative of a wide variety of blanks and formed pieces having different sizes and shapes to suit a particular finished piece 113 that can be made according to the present invention. It will be understood that the invention is not limited to using any particular size or shape blank or to forming any particular formed piece, nor is the invention limited to making any particular finished piece 113.

The illustrated blank 21 has a top surface 23, bottom surface 25, periphery 27, margin 29 along the periphery, and central area 30 inside the margin. The blank may be made from any of a number of different materials, as, for example, ASTM 620 DQAK.

Figure 5:
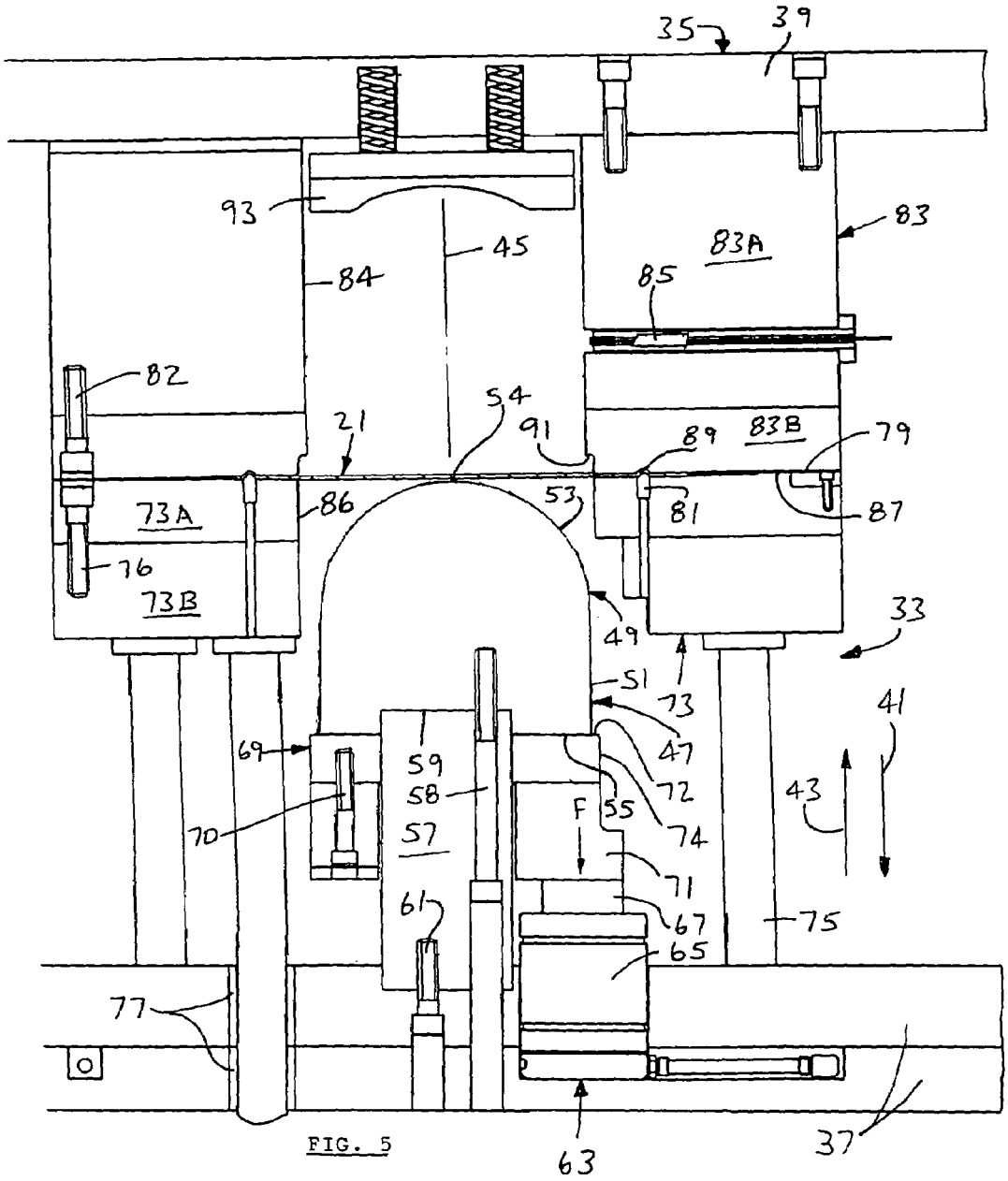
FIG. 5 is a cross-sectional view of the apparatus of the invention at the start of the draw stroke.

Turning to FIG. 5, the apparatus of the invention is shown at reference numeral 33. The apparatus 33 is incorporated into a conventional deep draw press 35 having a bed 37 and a ram 39. The ram 39 reciprocates in the directions of arrows 41 and 43 relative to the bed 37 and parallel to a longitudinal axis 45 of the apparatus.

Stationarly supported on the press bed 37 is a punch 47. The punch 47 has a first end 49 that is sized and shaped with the contour of the piece 31 to be formed by the apparatus 33. It will be appreciated that the punch first end 49 may have a different size and contour from that depicted so as to suit both the blank 21 and the formed piece 31. In the illustrated embodiment, the punch first end has a continuous side surface 51 that is generally parallel to the longitudinal axis 45. The side surface 51 blends smoothly into a curved convex surface 53. An apex 54 on the convex surface 53 is the most distance point on the punch first end from the press bed 37.

The punch 47 also has a second end 55. The punch second end 55 is supported on the press bed 37 by one or more pedestals 57 and fasteners 58 and 61. If desired, the punch second end may have a recess 59 that receives the pedestal 57.

In the press bed 37 are a number of fluid cylinders 63. Each cylinder 63 has a casing 65 and a piston 67. The cylinders are pre-charged to a high pressure such that a considerable force F is required to push the pistons 67 into the respective casings 65. The preferred cylinder employs nitrogen as the fluid. A typical pre-charge force is on the order of 7.5 tons; that is, a force F of 7.5 tons is required to push the pistons into the casings.

Between the stationary punch second end 55 and the cylinders 63 is a pad 69. The pad 69 may be fastened to a spacer 71, if desired, as with fasteners 70. In that case, it is the spacer 71 that actually contacts the cylinders. For simplicity, the combination pad, spacer, and fasteners 70 will hereinafter be collectively referred to as the pad 69. The pad 69 rests on the cylinder pistons 67. The pad has a ledge 72 that extends transversely of the punch continuous side surface 51. The pad ledge 72 terminates at an exterior surface 74 parallel to the punch side surface.

A blank holder 73 is reciprocable in the directions of arrows 41 and 43. As illustrated, the blank holder 73 is in two separate parts 73A and 73B fastened together by fasteners 76, but the blank holder may be a single component, if desired. For simplicity, the components 73A, 73B, and 76 will be referred to collectively as the blank holder 73. The blank holder has an interior surface 86. There is a slight clearance between the blank holder interior surface 86 and the pad exterior surface 74. To reciprocate the blank holder, several pins 75 are slideable in the press bed 37. The pins 75 are accurately guided, such as by bushings 77. The blank holder has a holding surface 79. It is preferred, but not mandatory, that several draw beads 81 be used with the blank holder. The draw beads 81 are well known to persons skilled the metal forming arts, so it is believed that a detailed description of them is not needed.

Joined to the press ram 39 is a draw ring 83. The draw ring 83 may comprise two parts 83A and 83B fastened with fasteners 82, as is illustrated. However, for simplicity in understanding the present invention, the components 83A, 83B, and 82 will be collectively referred to hereinafter as the draw ring 83. The drawing ring 83 has an interior surface 84. The interior surface 84 is spaced a distance from the punch continuous side surface 51 by a distance slightly greater than the thickness of the blank 21 (FIG. 4). A sensor 85 may be installed in the draw ring opening from the interior surface 84. The draw ring also has a contact surface 87. In the contact surface 87 are depressions 89 in alignment with respective draw beads 81 in the blank holder 73. At the junction of the draw ring contact surface 87 and the interior surface 84 is a step 91. Also in the press ram 39 is a known knockout 93.

To use the apparatus 33 to form the piece 31, the press 35 is opened such that the blank holder support surface 79 is approximately coplanar with the punch apex 54. In the press open position, there is a space between the blank holder support surface and the draw ring contact surface 87 such that the blank 21 can be inserted between those two surfaces. Then the ram advances in the direction of arrow 41 in a draw stroke. The blank margin 29 is held between the draw ring 83 and the blank holder 73 during the draw stroke.

Figure 6:
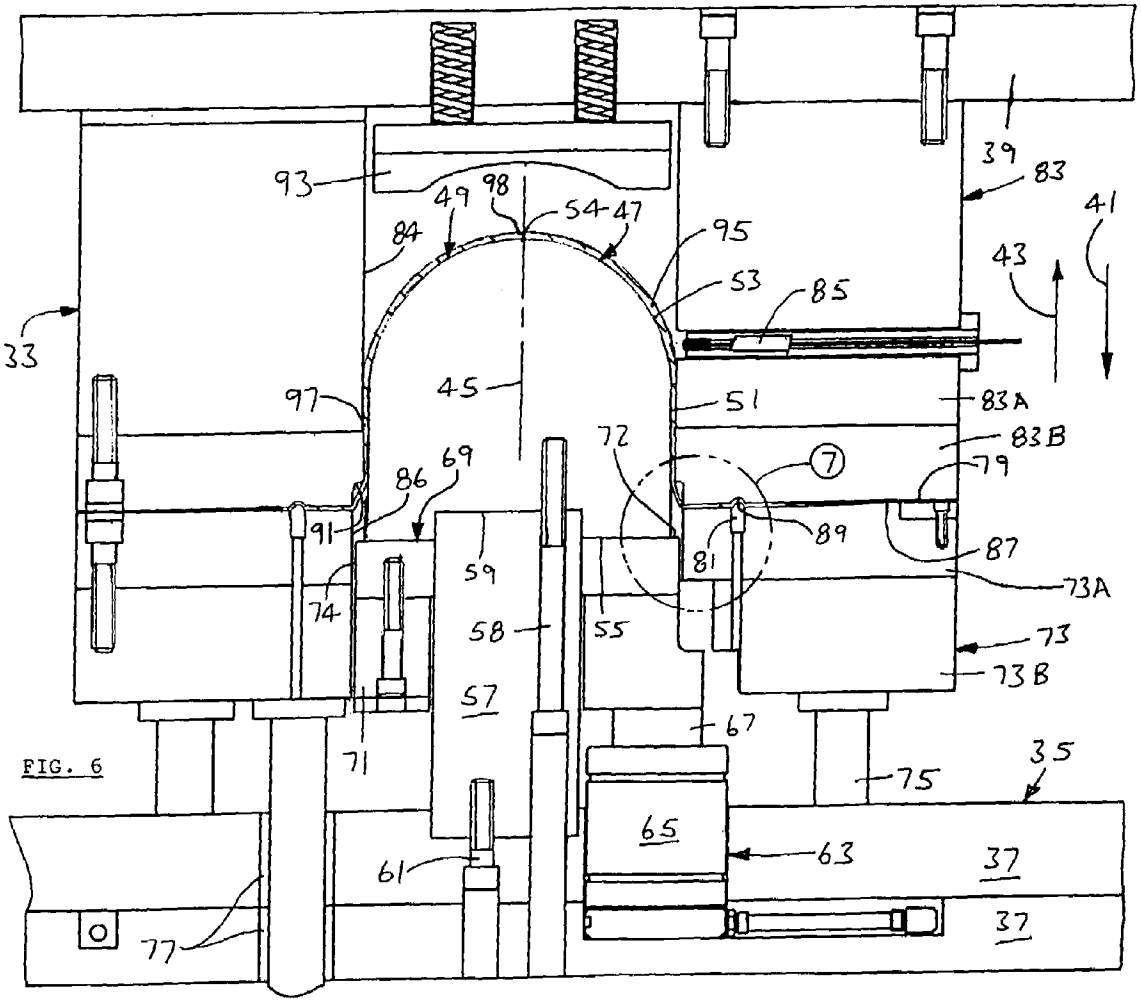
FIG. 6 is a view similar to FIG. 5, but showing the apparatus at a first intermediate position during the draw stroke.
Figure 7:
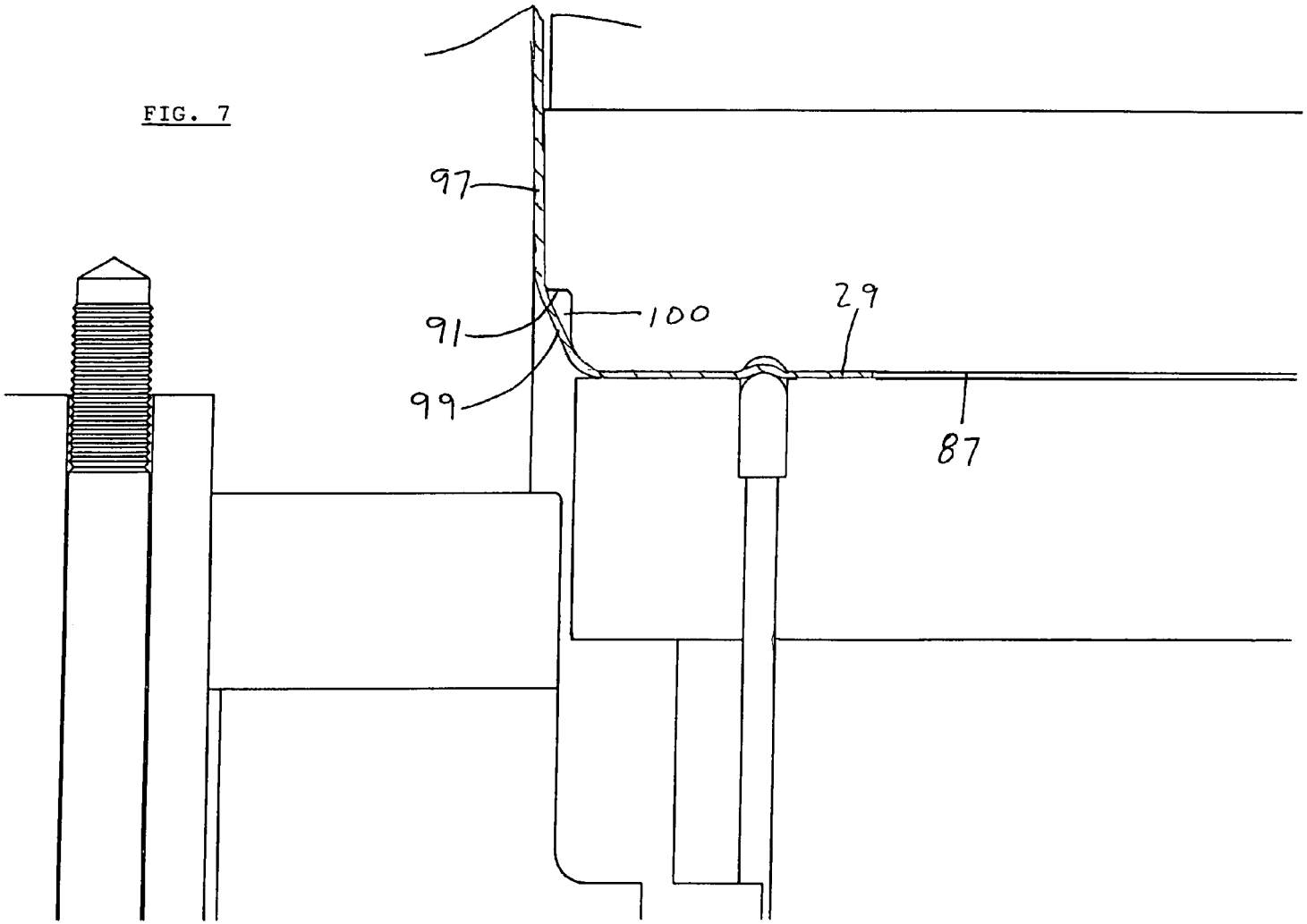
FIG. 7 is an enlarged view of Circle 7 of FIG. 6.

Now looking at FIGS. 6 and 7, the apparatus 33 is shown at a first intermediate position during the draw stroke 41. The ram 39 advances, pushing the draw ring 83, blank margin 29, and blank holder 73. The blank margin 29 is initially able to slip between the draw ring and the blank holder such that the blank central area 30 is able to bend over the stationary punch first end 49. The blank 21 is formed into a shape having a domed end 95 and an integral continuous wall 97. The blank domed end 95 has a crown section 98 that is bent adjacent and corresponds in configuration to the punch apex 54. A transition zone 99 between the blank continuous wall 97 and margin bends in a space 100 between the draw ring step 91 and the draw ring contact surface 87.

Figure 8:
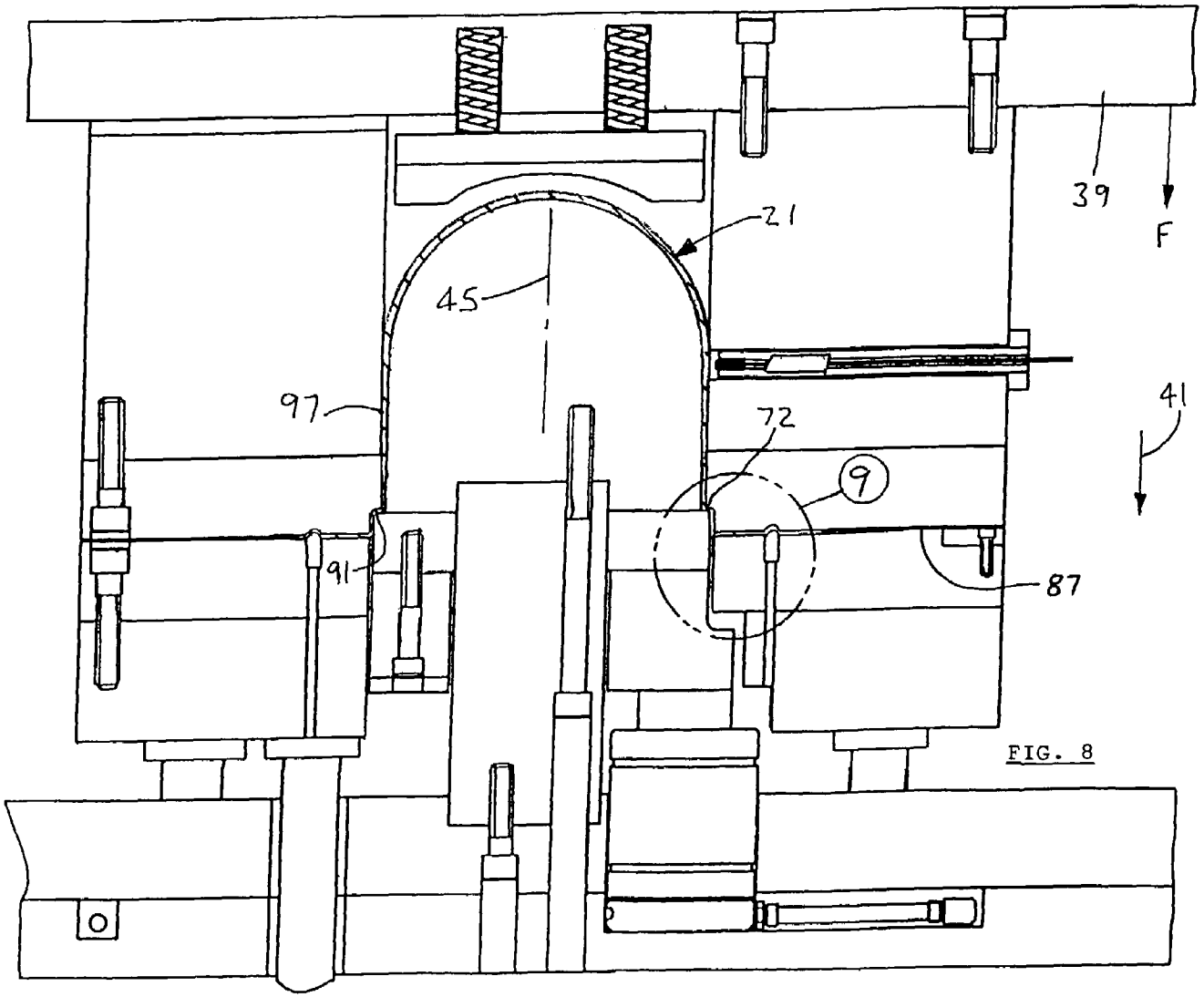
FIG. 8 is a view similar to FIG. 5, but showing the apparatus at the position during a draw stroke whereat the step-ledge has been created.
Figure 9:
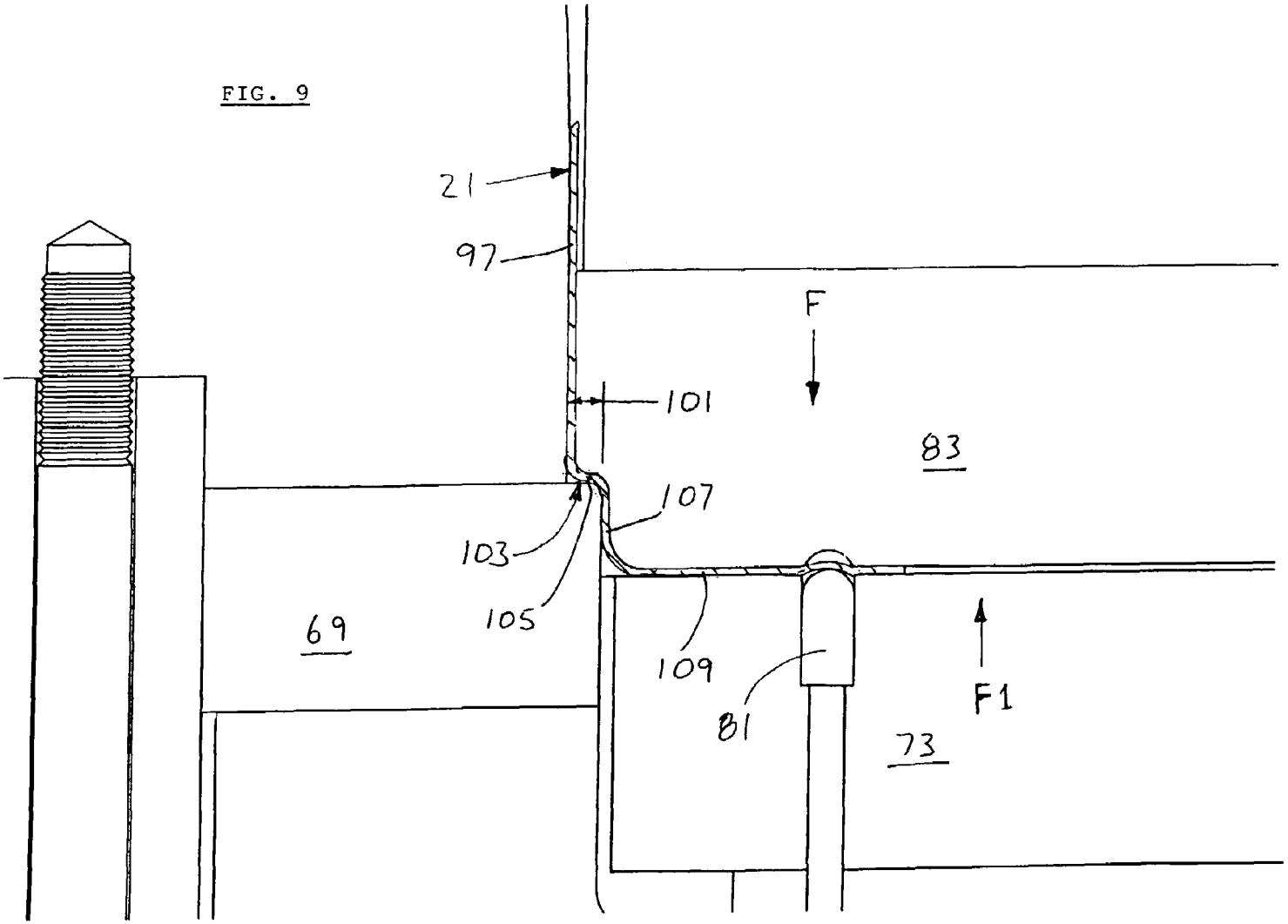
FIG. 9 is a view on an enlarged scale of Circle 9 of FIG. 8.

As the ram 39 continues to advance in the draw stroke 41, the draw ring step 91 approaches the pad ledge 72, FIGS. 8 and 9. The draw ring step eventually cooperates with the pad ledge to create a step-ledge, which is indicated at reference numeral 101. The ram exerts a force F sufficient to bend the blank 21 at the step-ledge 101 into a reverse bend 103. The reverse bend 103 consists of a strip 105 between the blank continuous wall 97 and another strip 107 parallel to the continuous wall. The strip 105 is preferably transverse to the apparatus longitudinal axis 45. The blank strip 107 bends into a flange 109 that is transverse to the longitudinal axis. The draw beads 81 assist gripping the blank flange 109 between the draw ring 83 and blank holder 73. The pre-charge force of the cylinders 63 is greater than the ram force F required to bend the reverse bend and flange 109. The pad 69 thus remains stationary and provides a reaction force F1 to the ram force and enables the step-ledge to bend the blank onto the reverse bend and to bend the flange.

Figure 10:
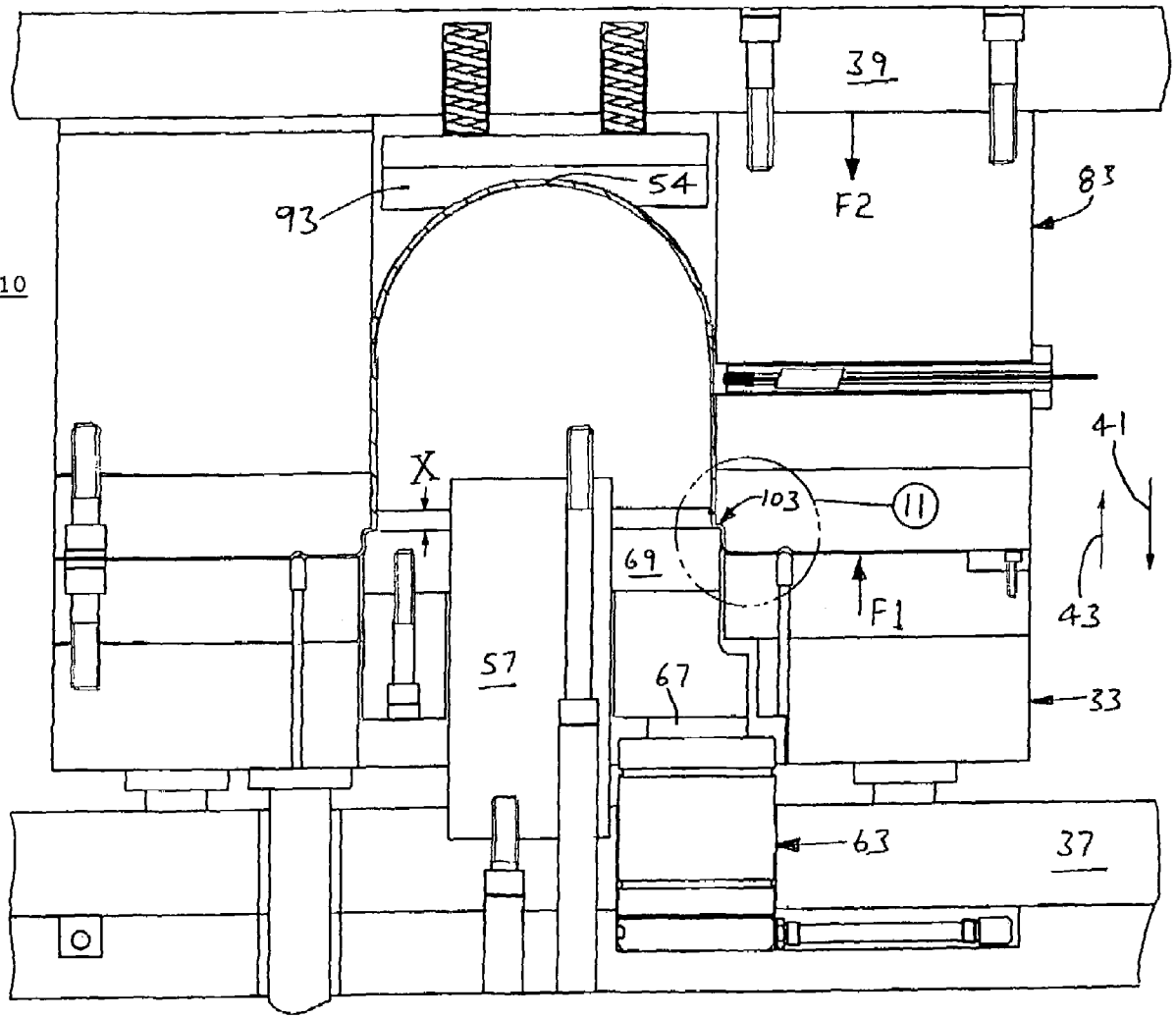
FIG. 10 is a view of the apparatus of the invention at the completion of the draw stroke.
Figure 11:
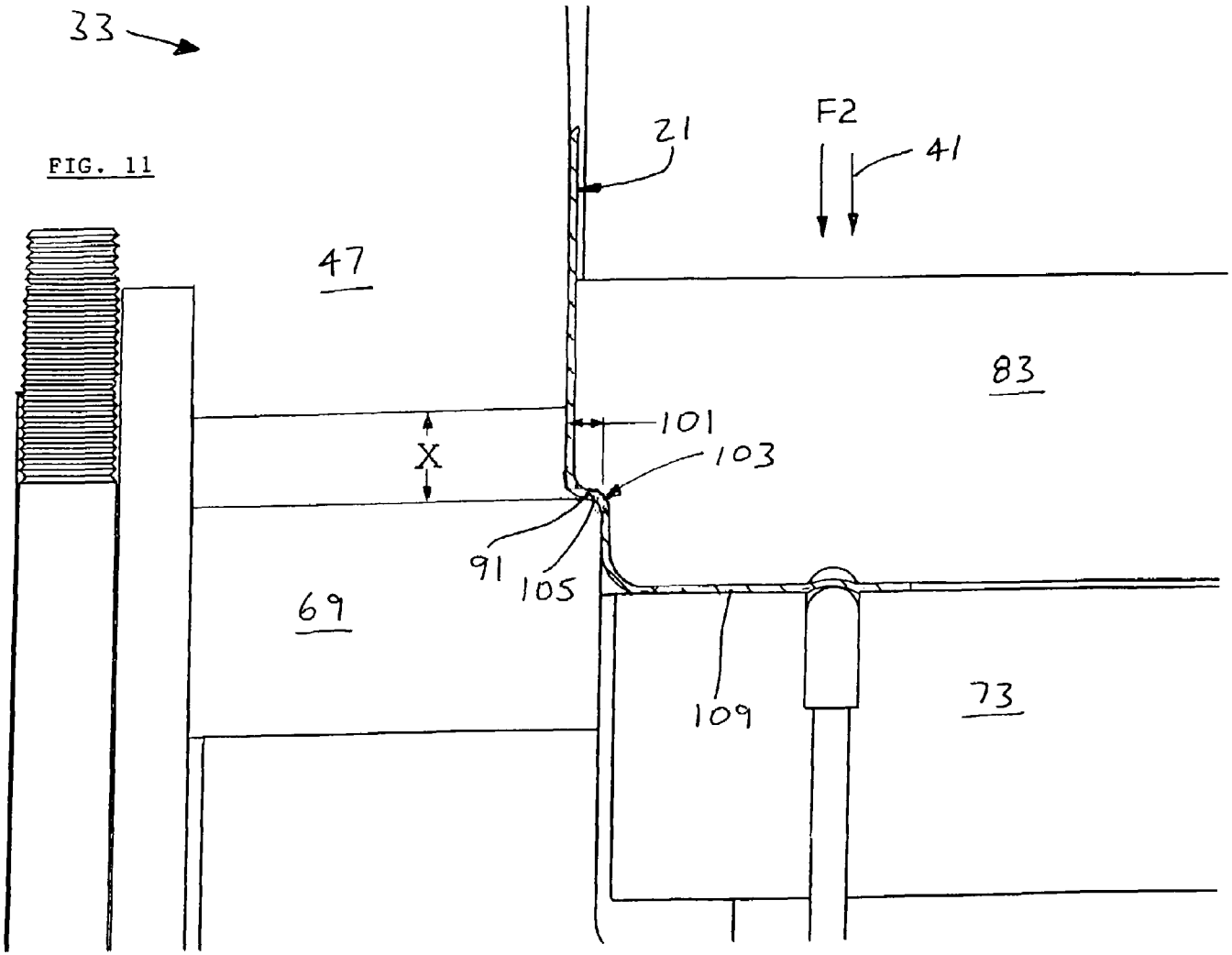
FIG. 11 is a view on an enlarged scale of Circle 11 of FIG. 10.

Next referring to FIGS. 10 and 11, the apparatus 33 is shown at the completion of the draw stroke 41. After the step-ledge 101 has been created and the reverse bend 103 has been produced, no clearance exists between the step-ledge and the blank reverse bend. The blank 21 is then immovably gripped between the draw ring 83 and the blank holder 73. However, in accordance with the present invention, the ram 39 continues to advance in the draw stroke. The ram exerts a sufficient force F2 to overcome the reaction force F1 and push the pad 69, by acting through the step-ledge 101 and the blank reverse bend strip 105, against the pistons 67 of the pre-charged cylinders 63. That is, the force F2 exerted by the ram is sufficient to overcome the pre-charge force of the cylinders. Consequently, the step-ledge 101, together with the blank reverse bend 103 and flange 109, travels an additional short controlled distance X relative to the punch 47. Since the punch remains stationary relative to the press bed 37 by virtue of the pedestal 57, and the blank crown section 98 also remains stationary, the blank material between the crown section and the reverse bend 103 is stretched by the travel X. Stated another way, the blank between the punch apex 54 and the step-ledge is stretched by the amount of the travel X. The actual travel X of the step-ledge is quite small; a typical travel is between approximately 0.100 and 0.300 inches. For clarity, the travel X is shown exaggerated in FIGS. 10 and 11. The amount of the step-ledge travel X is calculated to strain the blank material slightly beyond its yield point. Consequently, the blank material loses much of its normal elasticity. At that point, the blank 21 has been stretch formed into the formed piece 31 of FIG. 12.

At the completion of the draw stroke 41, the ram is reversed to open, arrow 43. The knockout 93 assures that the formed piece 31 releases from the draw ring 83. The formed piece is cut along a plane 111 though the continuous side wall 97 to make the finished piece 113 of FIG. 13. The finished piece 113 thus consists of the stretch formed continuous side wall and integral domed end 95. The side wall terminates at a free edge 115.

The outstanding advantage of the finished piece 113 made according to the present invention is that the stretched formed side wall 97 does not spring back relative to its configuration while still in the apparatus 33. Consequently, the finished piece free edge 115 remains at a stable and desired location. Therefore, the finished piece free edge can be readily aligned with the free edge 117 of another stable finished piece 119, FIG. 14, for welding the two pieces together. For example, the two pieces 113 and 119 may be welded together to make a fuel tank.

In summary, the results and advantages of deep draw presses can now be more fully realized. The apparatus 33 of the invention stretch forms blanks into formed pieces that have desired sizes and shapes as well as stable free edges. This desirable result comes from the combined functions of the step-ledge 101. During an initial phase of the ram draw stroke 41, the pad 69 produces a reaction force F1 to the force F exerted by the ram and draw ring on the blank, thereby enabling the blank to bend into the reverse bend 103. Under continued advancement of the ram, the step-ledge travels slightly relative to the punch. Consequently, the blank material is stretched over the punch. After the formed piece is removed from the press, it is cut along a plane thorough the formed piece side wall to make the finished piece. The stretching renders the finished piece stable in that it does not spring back from the configuration it had while still in the apparatus of the invention. The finished piece free edge is therefore able to be aligned and welded to another finished piece without difficulty.

It will also be recognized that in addition to the superior performance of the apparatus 33, its construction is such as to cost but little more than traditional deep drawing equipment. In fact, any increase in apparatus cost is quickly recouped because of the subsequent decreased alignment and welding time, as well as decreased scrap, compared to that endured prior to the present invention.

Thus, it is apparent that there has been provided, in accordance with the invention, apparatus for stretch forming blanks that fully satisfies the objects, aims, and advantages set forth. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. Apparatus for stretch forming blanks comprising:

a. a punch defining a longitudinal axis and having a first end sized and shaped with chosen configuration, a second end, and a side surface connecting the first end and the second end;

b. means for stationarily supporting the punch second end on a bed;

c. a plurality of fluid cylinders each having a casing in the press bed, and a piston, each cylinder being pre-charged to a predetermined force;

d. a pad between the punch second end and the cylinders pistons, the pad including a ledge that extends transversely from the punch side surface;

e. a blank holder surrounding the punch; and f. a draw ring surrounding the punch and having a step, the draw ring cooperating with the blank holder to hold a blank therebetween during a draw stroke during which the draw ring and blank holder advance in a direction parallel to the punch longitudinal axis to bend the blank over the punch first end and such that the draw ring step approaches the pad ledge and ultimately cooperates therewith to create a step-ledge and to bend the blank into a reverse bend at the step-ledge, the draw ring exerting sufficient force on the step-ledge to overcome the predetermined force of the cylinders and cause the step-ledge and cylinder pistons to travel a short distance, so that the blank between the punch first end and the step-ledge is stretched and the blank is stretch formed into a formed piece.

2. The apparatus of claim 1 further comprising a plurality of draw beads in a selected one of the blank holder and draw ring that assist in holding the blank between the blank holder and draw ring during a portion of the draw stroke.

3. The apparatus of claim 1 wherein the punch side surface is generally parallel to the longitudinal axis.

4. The apparatus of claim 1 wherein the means for stationarily supporting the punch comprises at least one pedestal between and fastened to the punch second end and to the bed.

5. The apparatus of claim 1 further comprising means for knocking out the formed piece from the draw ring.

6. The apparatus of claim 4 wherein the punch second end defines a recess that receives the at least one pedestal.

7. The apparatus of claim 1 wherein the cylinders are pre-charged to a force of approximately 7.5 tons.

8. The apparatus of claim 1 wherein:

a. the punch first end defines an apex; and b. the blank between the punch apex and the step-ledge is stretched in response to the travel of the step-ledge.

9. The apparatus of claim 1 wherein:

a. the punch first end defines a continuous side surface and a convex surface that blends into the side surface, the convex surface defining an apex;

b. the pad ledge extends transversely from the punch side surface; and c. the blank between the punch apex and the step-ledge is stretched in response to the travel of the step-ledge.

10. A method of stretch forming a blank into a formed piece comprising the steps of:

a. providing a blank;

b. providing a stationary punch having a first end of a chosen configuration including an apex, and a second end;

c. bending the blank over the punch first end such that the blank has a crown section adjacent and corresponding to the configuration of the punch apex;

d. bending a reverse bend in the blank; and e. stretching the blank between the crown section and the reverse bend and thereby stretch forming the blank into a formed piece.

11. The method of claim 10 wherein the step of bending a reverse bend in the blank comprises the steps of:

a. providing a draw ring with a step, and providing a pad with a ledge adjacent the punch second end;

b. advancing the draw ring in a draw stroke along a longitudinal axis;

c. creating a step-ledge with the draw ring step and the pad ledge; and d. bending the blank into the reverse bend at the step-ledge.

12. The method of claim 11 wherein the step of stretching the blank comprises the step of traveling the step-ledge a selected distance away from the punch second end.

13. The method of claim 11 wherein the step of bending the blank into a reverse bend comprises the steps of:

a. providing a pad having a ledge adjacent the punch second end;

b. providing a reaction force on the pad;

c. advancing a step on a draw ring into cooperation with the pad ledge and creating a step ledge; and d. bending the blank at the step-ledge into the reverse bend.

14. The method of claim 13 wherein the step of stretching the blank comprises the steps of:

a. exerting a force on the draw ring greater than the reaction force; and b. traveling the step-ledge in a direction away from the punch second end.

15. The method of claim 13 wherein:

a. the step of providing a stationary punch comprises the step of providing a stationary punch having a first end having a continuous side surface and convex surface that blends into the side surface; and b. the step of providing a pad comprises the step of providing a ledge that extends transversely of the punch continuous side surface.

16. The method of claim 15 wherein the step of providing a stationary punch comprises the step of providing a stationary punch having a continuous side surface that is parallel to the longitudinal axis.

17. The method of claim 14 wherein the step of traveling the step-ledge comprises the step of traveling the step-ledge in a direction parallel to the longitudinal axis.

18. The method of claim 13 wherein:

a. the step of providing a reaction force comprises the step of providing a plurality of fluid cylinders; and b. the step of bending the blank into the reverse bend comprises the steps of:

i. pre-charging the cylinders with a predetermined force;

ii. contacting the cylinders with the pad; and iii. exerting the predetermined force on the pad in response to bending the blank into the reverse bend at the step-ledge.

19. The method of claim 12 wherein the step of traveling the step-ledge comprises the steps of:

a. providing a plurality of fluid cylinders in contact with the pad and pre-charged with a pre-charge force; and b. exerting a force on the step-ledge sufficient to overcome the cylinders pre-charge force and thereby causing the cylinders and the step-ledge to travel the selected travel.

20. The method of claim 11 wherein the step of bending a reverse bend comprises the steps of:

a. providing a plurality of cylinders each pre-charged with a predetermined pre-charge force;

b. contacting the cylinders with the pad; and c. exerting a force by the draw ring sufficient to bend the blank into the reverse bend and simultaneously providing a reaction force by the pad and the cylinders equal to the draw ring force and thereby enabling the step-ledge to bend the blank into the reverse bend.

21. The method of claim 10 comprising the further step of cutting the formed blank along a plane between the crown section and the reverse bend.

* * * * *